United States Patent [19]

Argade et al.

[11] 4,175,023

[45] Nov. 20, 1979

[54] COMBINED CATHODE AND DIAPHRAGM UNIT FOR ELECTROLYTIC CELLS

[75] Inventors: Shyam D. Argade, Woodhaven, Mich.; Thomas G. Coker, Natick, Mass.

[73] Assignee: BASF Wyandotte Corporation, Wyandotte, Mich.

[21] Appl. No.: 924,896

[22] Filed: Jul. 17, 1978

Related U.S. Application Data

[60] Continuation-in-part of Ser. No. 694,976, Jun. 11, 1976, abandoned, Division of Ser. No. 611,030, Sep. 8, 1975, Pat. No. 4,049,841.

[51] Int. Cl.[2] ..... C25B 11/03; C25B 11/04; C25B 13/08

[52] U.S. Cl. ..... 204/252; 204/283; 204/290 R; 204/296

[58] Field of Search ..... 204/129, 128, 290 R, 204/282–283, 252, 296

[56] References Cited

U.S. PATENT DOCUMENTS

| | | | |
|---|---|---|---|
| 3,974,058 | 8/1976 | Gokhale | 204/290 F X |
| 4,024,044 | 5/1977 | Brannon et al. | 204/290 R X |
| 4,036,729 | 7/1977 | Patil et al. | 204/296 |

FOREIGN PATENT DOCUMENTS

| | | | |
|---|---|---|---|
| 62308 | 9/1967 | Fed. Rep. of Germany | 204/129 |
| 1299287 | 7/1969 | Fed. Rep. of Germany | 204/128 |

*Primary Examiner*—John H. Mack
*Assistant Examiner*—D. R. Valentine
*Attorney, Agent, or Firm*—Robert J. Henry; Joseph D. Michaels; Robert E. Dunn

[57] ABSTRACT

An especially efficient and durable electrolytic cell is provided by utilizing a combined cathode and diaphragm unit wherein the cathode is made by spray coating a ferrous metal substrate with a powder metal having lower hydrogen overvoltage than said substrate to form a protected cathode surface having a larger surface area than the substrate, and vacuum depositing fluorinated hydrocarbon polymer fibers onto the spray coated surface of the cathode to form a fibrous diaphragm securely adhered thereto. Preferably, the cathode surface is made with nickel and the fluorinated hydrocarbon polymer is selected from the group consisting of homopolymers of chlorotrifluoroethylene and copolymers of chlorotrifluoroethylene and at least one compatible monomer with units of chlorotrifluoroethylene accounting for at least 80 percent of the monomeric units of said copolymer.

16 Claims, No Drawings

COMBINED CATHODE AND DIAPHRAGM UNIT FOR ELECTROLYTIC CELLS

CROSS-REFERENCE TO RELATED APPLICATIONS

This application contains in part the disclosure of our copending application Ser. No. 694,976 filed June 11, 1976 for "SPRAYED CATHODES", now abandoned, which application is a divisional application of U.S. patent application Ser. No. 611,030, filed Sept. 8, 1975, entitled "SPRAYED CATHODES", now U.S. Pat. No. 4,049,841. The disclosure of this patent is also herein incorporated by reference.

BACKGROUND OF THE INVENTION

1. Field of the Invention

The present invention relates to a combined cathode and diaphragm unit for electrolytic cells, and more particularly the present invention relates to such units for electrolytic cells utilized for the electrolysis of sodium chloride.

2. Prior Art

The making of diaphragms for brine-electrolysis cells from asbestos has been widely practiced throughout the world for many decades. Those skilled in the art are familiar with the techniques involved, wherein asbestos is formed in a slurry and drawn through the cathode screen in a vacuum box to provide a diaphragm wherein the asbestos fibers are entwined with the screen and with each other. In this way, a unit is obtained that will remain intact during operation in spite of vigorous hydrogen generation at the cathode screen. One of the disadvantages of this construction is that the physical intimacy and/or the interaction between the asbestos and cathode screen interferes somewhat with the generation of hydrogen at the cathode and tends to increase electrical resistance due to bubble retention. Another disadvantage is the use of asbestos, the use of which is becoming increasingly regarded as a health hazard.

However, the use of substitutes for asbestos is a relatively new technology, and improvements in the technology of such substitutes is necessary to render the new technology practical. The present invention relates to one of such improvements. One satisfactory substitute which has been found and is known to the prior art is the use of relatively inert synthetic plastic material which may be formed into small fibers and deposited by known techniques to provide fibrous diaphragms. An example of such a diaphragm is shown in U.S. Pat. No. 4,036,729. Other improvements have been made in the use of these synthetic fibers to make satisfactory diaphragms, involving the use of fluorinated hydrocarbon resins, heat treatments, and the like in order to render the diaphragms more satisfactory. In addition, these synthetic fibers are hydrophobic and have presented difficulties not present with hydrophilic asbestos fibers. Accordingly, it is also known to utilize surfactants to render the fiber diaphragms more wettable.

As noted above, U.S. Pat. No. 4,049,841 discloses a cathode having special surface characteristics which may be combined with asbestos diaphragms and provide an improvement in lowering the hydrogen overvoltage of the cathode. Similarly, U.S. Pat. Nos. 3,945,907 and 3,974,058 show special cathodes having a low hydrogen overvoltage. However, it is believed that the advantages achieved by the combined cathode and diaphragm unit of this invention are not suggested by any of these prior art patents.

SUMMARY OF THE INVENTION

In accordance with the invention, a cathode and diaphragm unit is provided for electrolytic cells which provides an improved efficiency of operation. First of all, the use of the sprayed cathode provides a reduced hydrogen overvoltage that provides a considerable cost saving in energy. Secondly, the use of the synthetic diaphragms provides for improved contact between the diaphragm fibers and the cathode. In addition, the combination of the electrode, which has a roughened surface, and the synthetic diaphragm allows for the diaphragm to be deposited on the cathode with considerably less coverage thereof than in asbestos diaphragms heretofore used with a resulting better hydrogen generating surface, improvements in disengagement of the hydrogen bubbles from the cathode, and an overall improvement in cell energy efficiency as a result of the combination.

In a copending application, Ser. No. 742,818, filed Nov. 18, 1976 now U.S. Pat. No. 4,126,535, and having common ownership with the present invention, and as it is pointed out therein, the fiber diaphragm in operation develops skin layers substantially separating itself from the hydrogen generating cathode. Hence, the gas bubbles formed between the cathode and the diaphragm do not have a tendency to be trapped. Thus, the coated cathode and the diaphragm combination is synergistically efficacious.

Thus, the invention provides a chlor-alkali electrolysis cell having a cathode and the fibrous diaphragm juxtaposed thereto, in which the cathode and diaphragm are provided as a unit comprising a cathode screen and a fibrous diaphragm composed of an organic thermoplastic polymer. The cathode has a roughened surface obtained by spray coating a powder metal on a ferrous metal substrate with the powder metal having a lower hydrogen overvoltage than said substrate, and having a larger surface area than the area of said substrate.

The invention also provides a process for manufacturing the chlor-alkali electrolysis cell containing the cathode and diaphragm unit of this invention. In the method form of the invention, the improvement comprises spray coating a ferrous metal substrate with a powder metal having a lower hydrogen overvoltage than said substrate to form a cathode with the cathode surface having a larger true surface area than the geometric surface area of the substrate, and vacuum depositing thermoplastic polymer fibers from a slurry onto the spray-coated surface of the cathode to form a fibrous diaphragm adhered thereto.

DESCRIPTION OF THE PREFERRED EMBODIMENTS

As hereinbefore noted, the present invention contemplates the spraying of a powder metal onto a conventional cathode deployed in an electrolytic chlor-alkali cell. The powder metal is either flame sprayed or plasma sprayed onto the cathode.

With more particularity, the present invention contemplates the spraying of a powder metal onto a ferrous metal cathode utilized in an electrolytic chlor-alkali cell. The chlor-alkali cell can be either a monopolar or bipolar cell. Furthermore, the cell employs a synthetic polymeric deposited diaphragm such as those manufactured from perfluorinated polymers, chloro-substituted perfluorinated polymers, sulfonated polymers and the like.

As noted, the powder metal is either flame sprayed onto the cathode or plasma sprayed onto the cathode. The spraying of the metal onto the cathode surface provides a high degree of bonding while increasing the surface area of the cathode. Furthermore, by spraying the coating onto the surface, the resulting roughened surface provides the proper conditions for efficient hydrogen bubble release. This is to be contrasted with the prior art noted hereinbefore which did not enhance the efficiency of the hydrogen bubble release.

Flame spraying and plasma spraying techniques, per se, are known. Flame spraying generally comprises spraying and fusing a powder metal onto a metallic surface with a flame. Such flames are generated with a torch or similar apparatus. Such apparatus and techniques are more comprehensively discussed in U.S. Pat. Nos. 3,238,060; 2,786,779 and 3,220,068.

Plasma spraying generally comprises the utilization of an electric arc discharge through which a plasma gas is passed. As the gas passes the electric arc the gas is ionized. Thus, there is achieved a plasma or ionized gas. There is admixed with the plasma of ionized gas, a powder metal suspended in a carrier gas therefor. Usually, a plasma spray gun is utilized for the plasma spray coating. Such guns are known. One such gun is depicted in U.S. Pat. No. 3,630,770.

In practicing the present invention, it is preferred to plasma spray coat the cathode. Plasma spraying provides a higher temperature and a more non-oxidizing atmosphere than flame spraying and results in a greater degree of bonding than flame spraying. In fact, plasma spraying provides a substantially non-oxidizing atmosphere. The gases employed in plasma spraying are nitrogen and hydrogen, wherein hydrogen gas is ionized and the powder metal is suspended in the nitrogen.

The powder metals which can effectively be employed herein are those which have a lower hydrogen overvoltage than the ferrous metal used in manufacturing the cathode. Representative of the metals which can be used herein include, for example, cobalt, nickel, platinum, molybdenum, tungsten, manganese, iron, tantalum, niobium and mixtures thereof. In addition, alloys of these metals can be used. Also, metallic compounds such as carbides, nitrides and the like can be used such as tungsten carbide, iron nitride and the like. The pure metals can be used alone or can be admixed with the alloys and the compounds. Also, the alloys and the metallic compounds can be used alone. The only criteria attached to the metal are that it be a powder capable of being sprayed and have a lower hydrogen overvoltage than the cathode material. In the practice of the present invention, the preferred powder metal is nickel.

The metal is sprayed onto the cathode to a thickness of about 0.001 to about 0.006 inches. Preferably, the metal is deposited to a thickness of from about 0.002 to about 0.005 inches. By spraying the metal powder onto the cathode surface, the surface area is increased due to the uneveness of the sprayed particles and the inherent surface porosity of the coating.

The thermoplastic fibers contemplated for use herein are the fluorinated hydrocarbon polymers, and in particular fluorinated polyalkylenes. The fluorinated polyalkylenes can be additionally halogen substituted fluorinated polyalkylenes. Representative of the fluorinated hydrocarbon polymers are polytetrafluoroethylene, fluorinated ethylene-propylene copolymers, polychlorotrifluoroethylene, polyvinylidine fluoride, polyethylenechlorotrifluoroethylene, polyethylenetetrafluoroethylene and tetrafluoroethylene perfluorovinyl ether sulfonylfluoride copolymers. Most preferred, are the homopolymer of chlorotrifluoroethylene, and a copolymer containing chlorotrifluoroethylene and vinylidine fluoride with at least 80 percent of the copolymer being chlorotrifluoroethylene. It is also possible to use these polymeric fibers along with minor amounts of other fibers such as asbestos, potassium titanate, glass, silica, zirconia fibers and silicate, borate and phosphate fibers.

In general, the synthetic fibers may be prepared by the procedures given in U.S. Pat. No. 4,036,729 or for the preferred fibers by the procedure given in application Ser. No. 742,818 filed Nov. 18, 1976. The disclosures of which are incorporated herein by reference.

Thus, the chemical content of one of the preferred fibers to be utilized is a composition based upon a terpolymer containing over 80 percent chlorotrifluoroethylene and minor amounts of vinylidene fluoride and tetrafluoroethylene. Such material is commercially available from Allied Chemical Co. under the name "Alcon 2000". Another preferred fiber is made from the homopolymer of chlorotrifluoroethylene sold by 3M Company as "Kel-F 81".

Such material is put into the form of fibers having a cross section on the order of one micron by four microns and a length of approximately 0.25 to 0.5 millimeters in accordance with a modification of a process which is adequately described in Belgium Pat. No. 795,724. The surface area of such fibers is five to 20 square meters per gram as measured by nitrogen adsorption. There is thus produced material which is, in effect, water soaked fiber bundles, containing 80 to 90 percent by weight water, made by draining the output of the process conducted according to the above-mentioned Belgian patent on a perforated moving bed.

As is known to those skilled in the art, fluorinated hydrocarbon fibers, per se, are difficult to disperse in an aqueous medium, thereby, rendering such fibers difficult to deposit on a cathode screen or support. Thus, it is customary to add a surfactant and disperse the fibers in an aqueous-acetone medium. The surfactant is employed in amount ranging from about 0.01 percent to about ten percent, by weight, based on weight of the slurry all of which is shown in the prior art.

The slurry is then vacuum deposited on a cathode screen by any suitable method. A particularly preferred method of depositing slurry involves the immersion of the cathode screen, mounted in a vacuum box, into the slurry which is maintained in the state of agitation. Then, a series of increasing partial vacuums are applied across the screen for a period of time followed by a full vacuum for a predetermined period of time. Screen having the fibers deposited thereon is, then, dried at a temperature higher than room temperature, say, 100° C. for about one to three hours to evaporate the water.

For a more complete understanding of the present invention, reference is made to the following examples. In the examples, which are intended to be illustrative only and not limitative of the invention, all parts are by weight, absent indications to the contrary.

EXAMPLE 1

A combined diaphragm and cathode unit was made according to the present invention. The cathode used was a mild steel screen plasma sprayed on both sides with nickel in accordance with our copending applications cross-referenced above. The composition of the diaphragm was "Aclon 2000" polymer. The average cross-sectional dimensions of the fibers used to form the diaphragm were 1 micron by 4 microns, further branched into finer fibers, with a length of 0.25 to 0.5 millimeters. Such fibers were suspended in water, to the extent of 12.7 grams per liter (dry weight of fiber employed), along with 4 grams per liter of dioctyl sodium sulfosuccinate and 2 grams per liter of a fluorine-containing surfactant, namely, that sold by 3M Company under the designation FLUORAD "FC-170".

Fiber dispersion and slurry agitation were performed with the use of a propellor-type mechanical agitator driven by a "Lightnin" mixer.

A two-layered web was formed by drawing two successive volumes of slurry through the cathode screen at a ratio of 8.3 milliliters of slurry per square centimeter of screen area per layer according to the following schedule: 2 minutes at 25 millimeters of mercury difference from atmospheric pressure, 3 minutes further at 50 millimeters of mercury difference in pressure, and 2 minutes further at 100 millimeters of mercury difference in pressure.

The second layer was then applied: 3 minutes at 50 millimeters of mercury difference from atmospheric pressure, 8 minutes further at 100 millimeters of mercury difference in pressure, and 2 minutes further at 150 millimeters of mercury difference in pressure. The full vacuum of 615 millimeters of mercury was then applied for 20 minutes. There was obtained a diaphragm having a gross thickness of 2.7 millimeters and having a permeability coefficient $1.7\times10^{-9}$ square centimeters. After being dried at 100° C. for 16 hours, the unit is ready for use in a chlor-alkali cell.

EXAMPLE 2

A steel cathode screen was plasma spray coated on one side with nickel powder to a thickness of 0.002 inches. A fiber diaphragm was then vacuum deposited on the coated side of the cathode in accordance with the procedure of Example 1.

After 40 days of operation in a chlor-alkali cell, the electrode potential was 1.23 to 1.27 volts versus standard calomel electrode (SCE) at 80° C. and a current density of 160 ma per square centimeter. In previous measurements, an uncoated steel cathode with an asbestos diaphragm had an electrode potential of 1.35 to 1.40 volts versus SCE under the same conditions. A cathode plasma coated with nickel on one side with an asbestos diaphragm had an electrode potential of 1.27 to 1.29 versus SCE.

EXAMPLE 3

The procedure of Example 2 was repeated by coating the cathode on both sides and the unit tested as in Example 2. After 40 days of operation, the electrode potential of the cathode was 1.22 to 1.27 volts versus SCE.

EXAMPLE 4

A steel cathode screen was electroplated with bright nickel. An "Aclon" fiber diaphragm was then vacuum deposited on the cathode screen using the procedure of Example 1. After 15 days of operation in a chlor-alkali cell, the cathode potential was 1.32 to 1.35 volts versus SCE.

From the foregoing data, it is seen that the invention provides improved electrical characteristics in a chlor-alkali cell, and that both elements of the combination contribute to the improvement.

The embodiments of the invention in which an exclusive property or privilege is claimed are defined as follows:

1. In a method for manufacturing a chlor-alkali electrolytic cell having a cathode and a fibrous diaphragm juxtaposed thereto, the improvement comprising spray coating by plasma spraying or flame spraying a ferrous metal substrate with a powder metal selected from the group consisting of nickel, cobalt, tungsten carbide and mixtures thereof in a manner that forms the cathode with the cathode surface having a larger true surface area than the geometric surface area of the substrate, and vacuum depositing fibers onto a spray coated surface of the cathode to form the fibrous diaphragm securely adhered thereto, said fibrous diaphragm being formed from a fibrous slurry in which a major portion of the fibers are an organic thermoplastic polymer.

2. The method as defined in claim 1, wherein the substrate is spray coated by flame spraying the powder metal onto the substrate.

3. The method as defined in claim 1, wherein the substrate is spray coated by plasma spraying the powder metal onto the substrate.

4. The method as defined in claim 1, wherein the powder metal is nickel.

5. The method as defined in claim 1, wherein the diaphragm is homopolymer of chlorotrifluoroethylene.

6. The method as defined in claim 1, wherein the diaphragm is a copolymer containing chlorotrifluoroethylene and vinylidene fluoride and in which at least 80 percent of the monomeric units are chlorotrifluoroethylene.

7. The method as defined in claim 6, wherein the copolymer also contains a small amount of tetrafluoroethylene units.

8. In a chlor-alkali electrolysis cell having a cathode and a fibrous diaphragm juxtaposed thereto, a cathode and diaphragm comprising a cathode screen having a ferrous metal substrate, and a surface formed by spray coating a powder metal selected from the group consisting of nickel, cobalt, titanium carbide and mixtures thereof on said substrate, said powder metal having a lower hydrogen overvoltage than said substrate and having a larger true surface area than the geometric surface area of the substrate, and a fibrous diaphragm adhered to a surface of the cathode screen, said fibrous diaphragm comprising fibers the major portion of which are of an organic thermoplastic polymer.

9. The cell as defined in claim 8, wherein the substrate is spray coated by flame spraying the powder metal onto the substrate.

10. The cell as defined in claim 8, wherein the substrate is spray coated by plasma spraying the powder metal onto the substrate.

11. The cell as defined in claim 8, wherein the powder metal is nickel.

12. The cell as defined in claim 11, wherein the powder metal is nickel.

13. The cell as defined in claim 8, wherein the coating has a thickness of from about 0.001 to about 0.006 inches.

14. The cell as defined in claim 8, wherein the diaphragm is a homopolymer of chlorotrifluoroethylene.

15. The cell as defined in claim 8, wherein the diaphragm is a copolymer containing chlorotrifluoroethylene and vinylidene fluoride and in which at least 80 percent of the monomeric units are chlorotrifluoroethylene.

16. The cell as defined in claim 15, wherein the copolymer also contains a small amount of tetrafluoroethylene units.

* * * * *